US005419653A

United States Patent [19]

Hollon et al.

[11] Patent Number: 5,419,653

[45] Date of Patent: May 30, 1995

[54] METHOD OF MAKING A ROADWAY WITH A WATER-IMPERMEABLE MEMBRANE LAYER

[76] Inventors: Edmund D. Hollon, 130 Frontier Dr.; Blake D. Hollon, 1941 Park Dr., both of Douglas, Wyo. 82633

[21] Appl. No.: 217,971

[22] Filed: Mar. 25, 1994

[51] Int. Cl.[6] ..... E01C 7/34

[52] U.S. Cl. ..... 404/17; 404/27; 404/28; 404/82

[58] Field of Search ..... 404/27, 28, 31, 32, 404/81, 82, 17

[56] References Cited

U.S. PATENT DOCUMENTS 3,819,291 6/1974 McConnaughay ..... 404/82
3,909,143 9/1975 Cushman ..... 404/27
3,993,412 11/1976 Drane ..... 404/82

*Primary Examiner*—Ramon S. Britts
*Assistant Examiner*—Pamela O'Connor
*Attorney, Agent, or Firm*—Dean P. Edmundson

[57] ABSTRACT

This invention relates to asphalt concrete paving systems and how they are structured. For more than the last sixty years, such systems have been one integrated structure consisting of (1) one or more "lower supporting courses" and (2) one or more "surface wearing courses". Such systems are integrated structures and, therefore, cracking starting from either the top or bottom will proceed through the entire structure. This invention provides a third type of course, a "separation course" between the "lower supporting courses" and the "surface wearing courses". The "separation course" prevents bonding of the "lower supporting courses" to the "surface wearing courses". This "separation course" is a barrier to stop the cracking at this point. It is also waterproof and will stop water from getting into the "lower support courses" and causing them to fail. The concept of a "separation course" is applicable to both roadways and running tracks.

9 Claims, 1 Drawing Sheet

METHOD OF MAKING A ROADWAY WITH A WATER-IMPERMEABLE MEMBRANE LAYER

FIELD OF THE INVENTION

This invention relates to road and running track construction. More particularly, this invention relates to techniques for constructing roads and tracks in a manner such that cracking is minimized or greatly reduced.

BACKGROUND OF THE INVENTION

Early day running tracks were made of clay. These evolved into cinder and then crushed brick tracks. These were not all-weather surfaces. They offered little cushion to protect the athlete and no rebound to aid the runners. The most popular all-weather surface worldwide is an asphalt concrete street or road. Again, little or no cushion or rebound to the runner.

An asphalt concrete pavement roadway is constructed to carry loads with infinite load applications. Asphalt pavement is a general term applied to any pavement that has a surface constructed with an asphalt binder. Normally, it consists of a surface wearing course (layer) of mineral aggregate coated and cemented (bound) with asphalt; and one or more supporting courses. This asphalt pavement structure usually consists of three layers (courses).

Three layers (courses) are laid on a prepared subgrade. To get this subgrade to the proper line and grade, you will have cuts and fills. The cuts should be and are overcut or scarified usually a minimum of twelve inches. All of this fill and scarified material is brought to optimum (i.e., most favorable or best possible for a certain purpose) moisture content and is compacted to a certain uniform density. This prepared subgrade material is unbound material.

The first layer applied to the subgrade is the subbase. This subbase is usually granular material or selected soil. This layer is unbound and is normally not treated. It is, however, watered to optimum moisture content and compacted to a certain uniform density.

The second layer is the base course. This is compacted granular material (such as crushed rock, slag, gravel, sand, or a combination of such) or stabilized soil. Where it is an aggregate, it is referred to as aggregate base course, or simply ABC. This ABC is brought to optimum moisture content and compacted to a certain uniform density.

The third or top layer is the asphalt wearing surface. This is an asphalt bound aggregate mixture and is known as asphalt concrete. This asphalt concrete is usually applied in two or more lifts (layers or courses).

All of these layers are compacted to a very high percentage of their maximum density. Also, these layers are all bound securely together in accordance with conventional road engineering practices. This is to give this roadway the capability to support the load applications it is expected to receive. All of the research and development technology has evolved around this goal. Many generations of human beings have gone to this end.

Sometimes materials are used to treat or stabilize granular base and subbase materials or selected soils. These are Portland cement, lime, calcium chloride or salt (sodium chloride). In the case of adding Portland cement, it is added in lesser quantities than in Portland cement concrete. This turns these layers into a rigid material. This is sometimes referred to as soil cement. This makes this a bound layer.

Where the prime objective is to resist these load applications, they have come up with some very undesirable side effects, the major side effect being cracking. The transverse (across the roadway) cracking is the number one side effect in this three-layer road construction system. This transverse cracking is more predominant in cement treated aggregate base courses (usually called cement treated base or CTB).

This three-layer system has one very big built-in flaw which causes the transverse cracks in the top asphalt concrete layer. This flaw is reflection (or reflective) cracking.

REFLECTION CRACKING

Reflection cracking primarily occurs in resurfacing projects. An existing crack in the underlying pavement structure reflects upward through the new overlay. The asphalt overlay is new and resilient, but it still can't always absorb all the old pavement stresses that are concentrated at that one narrow line, thus a reflective crack develops.

Reflection cracking can also occur in a new pavement, when an underlying soil subgrade dries, shrinks, and forms wide cracks in the subgrade. These can sometimes reflect through the new asphalt pavement. *Pavement Maintenance,* P. H. Schmidt, September. 1991, p. 253–257.

Unbound granular base that is compacted to nearly 100% of its maximum density has a high shear resistance. Also, when it approaches maximum density, it will have minimum deflection when a load is applied. This will minimize the amount of compression and tension stresses within the pavement structure and spread the wheel-load through the pavement structure.

As previously mentioned, the prepared subgrade, subbase, and base are all brought to optimum moisture content. The water acts as a lubricant to allow all the particles to move among themselves and move into the air voids to reach the high density desired. The water has some binding qualities and adds to the cohesiveness of the moisture-laden layers mentioned above.

When the moisture goes out of these layers, they have to shrink. This shrinkage cracking is compounded by cool and cold weather shrinking. This puts a strain on the asphalt concrete beyond its ability to resist cracking.

The two salts, calcium chloride and sodium chloride, are used to try to stabilize the moisture content in these layers. This works to a degree, but a rather small degree. The salts have a small antifreeze effect on the moisture-laden material, the calcium chloride by far the most, but it is minimal at best.

The frost action on these materials does considerable damage. It not only loosens these layers, but also puts stress on the asphalt concrete from the heaving action.

The Portland cement treated base is really a win-lose situation. The roadway is capable of carrying much larger loads, but this layer breaks up into slabs. It is a rigid layer that gets transverse shrinkage cracking, with very wide cracks, in cold weather. This is similar to the joints opening in Portland cement concrete in cold weather.

Thus, when a resilient sports surface is adhered over the above type of "asphalt pavement system" substrate, the sports surface has all the problems of this "asphalt pavement system". An "asphalt pavement system" has not yet been designed without the above cracking and shifting problems. This leaves only one alternative and that is to not adhere the resilient surface to the asphalt pavement substrate.

Not adhering the resilient surface to the substrate can be done in many different ways, but in doing so a whole new set of problems are unleashed. Here are three problems:

1. Most of the resilient surfaces do not have sufficient internal strength to hold themselves together without being adhered to a solid base.
2. Most of them are not heavy enough to stay in place without being adhered to a solid base.
3. Most of them are not rigid enough to stay in place without being adhered to a solid base. No surfaces are known that meet all three of the above criteria.

The first truly all-weather track and sports surface was the sand-asphalt-rubber (SAR) surface. This SAR surface was placed on an asphalt pavement system substrate. The hot mix asphalt concrete is about 94% aggregate and 6% asphalt by weight. In the SAR mix, the crushed aggregate is replaced with sand, and rubber granules are also added as aggregate. The general proportion, by weight, is 76% sand, 12% rubber granules, and 12% asphalt. These proportions can vary depending upon materials used. As the sand is about four times as heavy as the rubber, the 12% rubber is about ⅔ as much volume as the sand. As you have much more volume of aggregate per ton, you double the asphalt.

In October 1988 a track was laid on an unbound base on Vancouver Island, B.C. Contact bonded urethane coated rubber granules and sand pebbles were mixed. This mixture was laid over an open graded unbound aggregate porous base to form a porous track system. This porous base was put over an unknown subgrade. This base consisted of first a minimum of 8 inches of 3" minus crushed gravel covered with 4 inches of ¾ minus crushed gravel. Around the inside and outside of this porous base was a drainage system to carry away the water that goes through the 1 inch track surface and into the gravel base. This would be very expensive.

There has not heretofore been provided a road or track construction which avoids the problems of cracking which are now common to asphalt concrete surfaces.

SUMMARY OF THE INVENTION

In accordance with one embodiment of the present invention there is provided a resilient track surface between ¼ inch to 3 inches thick, preferably in the 1 inch to 1½ inch range. This surface is laid on top of any substrate (e.g., asphalt concrete, portland cement concrete, packed soil, bound aggregate, treated aggregates and soils, etc.) and is not to be adhered to this underlying substrate in any way. The substrate could be either bound or unbound. This substrate could have a surface that the new resilient track surface would not or could not adhere to, or a separation course (or agent that has the same characteristics as the separation course described herein of being water-impermeable and capable of separating the lower support courses) from the surface wearing courses may be utilized, so the new resilient track would not or could not adhere to the substrate. This substrate could be either an existing surface or a newly-prepared substrate. An existing surface could be, for example, an existing track in good, like-new condition, or in any state of deterioration.

In the present invention, contrary to the commonly accepted road engineering practices of the prior art, the upper wear courses are not adhered to the underlying support courses. In other words, prior road engineering teachings dictate that all of the layers or courses of a road or track should be adhered or bound together in order to obtain a rigid construction with good load support capabilities. The present invention goes against the prior teachings by imposing a separation course between the lower support course and the upper wearing course. The separation course prevents cracks from proceeding upwardly or downwardly from the lower support course or the upper wearing course, respectively, through the separation course.

The new resilient surfacing system could be, but is not required to be, water impermeable. It could be water tight to the extent of keeping water from getting to the substrate. The separation course would be the impermeable barrier protecting the pavement or substrate system. The water that enters the resilient surfacing would migrate through this resilient surfacing layer to the edge and drain away.

This modified SAR (M-SAR) surfacing is similar to the SAR surfacing mentioned previously. Some of the aggregate may be replaced with larger rubber granules. The sand may be more on the pebble side as it is to add weight to help this surface lay in place. The asphalt will be a modified asphalt. It could be one of the rubberized asphalt that are becoming so popular. Modified asphalts are really not new as they have been around for a long time, some of them for more than thirty years. These asphalt modifiers greatly increase the tenacity (cohesiveness) of the asphalt. There are also many reinforcing materials that can be added to give the asphalt mix greater internal strength. Preferably a fibrous material is added to the asphalt surface aggregate mixture for reinforcement purposes.

Underlying the modified SAR surfacing is a layer of sand or other granular material which serves the purpose of a separation course, i.e., a sandwich layer of unbound granular fill material (sand or other granular material) which has a top and bottom "waterproof membrane" (skin, film, or sheet). The granular material can be wetted (lubricated) with a nonsetting material (petroleum distillate or wood or coal derivative) to facilitate consolidating (compacting) this sandwich core. This granular core can shift the slight amount needed to allow the layers below it to crack, shrink, swell, or shift without putting any stress or influence on any layers above this separation course. Both the layers above and below the sandwich cannot adhere to this granular core. They are separated by this "waterproof membrane" which can be any common flexible, durable plastic film, such as polyethylene film, that has the ability to elongate or stretch without rupturing. A synthetic rubber sheet with elastic capabilities would be better, but it is not necessary and would be much more expensive. Most of such rubbers would not resist degradation as well as polyethylene, however.

Other types of separation courses may be used in this invention, as will be apparent from the detailed description below. The essential characteristics of the separation course include water impermeability, flexibility and ability to elongate without rupturing.

The basic concept of this invention is that the separation course allows the upper courses and the lower courses to move relative to each other without adversely influencing each other. In other words, the separation course prevents compression and tension forces in the lower courses from affecting upper courses, and vice-versa. This concept is novel and is contrary to conventional road and track construction practice.

Other advantages will be apparent from the following detailed description and the accompanying drawings.

The ratios of the materials in the modified SAR layer may vary. Also, the diameter of particle size of the sand and rubber particles may vary, as desired.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

The concepts and techniques described herein are applicable to both road construction and track construction. The sand-asphalt-rubber (SAR) surface is highly desirable because it exhibits sufficient elasticity, resiliency, internal strength, flexibility, and other desirable characteristics to enable the surface to be laid over an asphalt concrete pavement system. The SAR system suffers the same fate as streets, highways, and parking lots, i.e., cracking. However, the modified SAR surfacing described herein can be laid over a variety of substrates, such as: compacted aggregate base course, sand, asphaltic concrete base, Portland cement concrete base, compacted existing on-site materials, existing track surfaces, existing play or sports surfaces, etc.

The reinforcing materials used in the SAR layer are fibrous in nature and may be natural or synthetic. Examples include wool, animal hair, cotton, cane (Bagasse), wood, grasses (e.g., bamboo), hemp, hulls (e.g., walnut, cotton seed, almonds), husks, peach pits, asbestos, talc, or processed mineral (such as rockwool or fiberglass). The quantities of reinforcing material used may vary greatly, as desired.

Rubberized asphalt binder using one or more resins can be used in lieu of non-modified asphalt binder. The asphalt can be further modified by adding various types of rubber granules, oil-soluble rubber, kerosene, process oil, fluxing oils, etc.

The modified SAR surfacing material is useful in a variety of applications, e.g., running tracks, playing surfaces, sports surfaces, walkways, landscape surfaces, etc., when used in accordance with the techniques of this invention.

Figure 1:
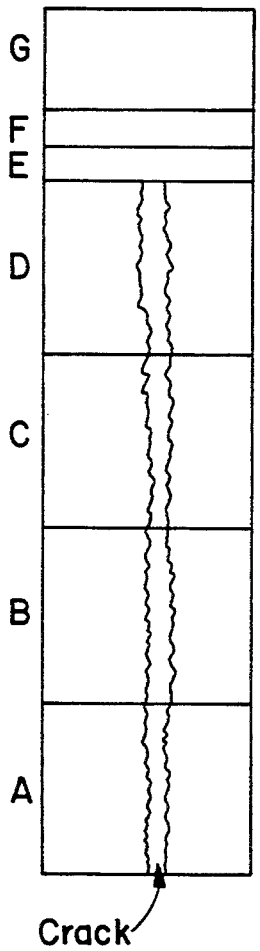
FIGS. 1–3 are schematic diagrams illustrating the techniques of this invention.

FIG. 1 illustrates a system in which a modified sand-asphalt-rubber (M-SAR) resilient surface is applied over an existing substrate comprising prepared subgrade A, subbase course B, base course C, and asphalt concrete surface course D. Courses A through D serve the function of a support course. A separation course E lies over the asphalt concrete surface course D. The separation course may comprise a sandwich of two polyethylene films separated by a granular fill (sand or other granular material). If desired, the granular fill material can be wetted with non-hardening petroleum distillate or other similar products derived from wood or coal. The thickness of the separation course may vary.

The separation course may be composed of a variety of materials so long as it is water-impermeable and is able (1) to prevent cracks in the lower support course from proceeding through to the upper wearing course, and (2) to prevent cracks in the upper wearing course from proceeding downwardly into the lower support course.

The separation course could be as simple as two or more plastic films separated by a lubricant (e.g., talc) to prevent them from sticking together. As another example, the separation course could be a layer of flexible, elastic or durable rubber which is water-impermeable. The separation course prevents the wear layer (i.e. upper surface course) from being bonded or adhered to the support course substrate. Although the separation course could be adhered to the support course substrate and/or the wearing course, it is necessary for the lower courses and upper courses to be sufficiently independent of each other that the separation course prevents cracks in either the lower or upper courses from proceeding through the separation course to the other course.

The courses below the separation course E are the supporting courses (i.e. substrate) for the pavement system and give the system its stability to maintain or restore its equilibrium when acted upon by loads or other forces tending to displace it. The courses above the separation course E are the surface courses and have to resist the wear applied by the use intended (such as a running track or roadway). The two basic facts of any pavement system are that they wear out from the top and fail from the bottom.

Above the separation course E there is placed a cold mix asphalt concrete protection course F which may be, for example, about 0.5 inch thick. The top layer or course G is the M-SAR resilient surface comprising asphalt bound granular rubber, urethane bound granular rubber, latex bound granular rubber, solid urethane, or granular filled urethane resilient track surface (or comprising a combination of these or other elastomeric materials. The thickness of the course G may vary from about 0.25 inch to 3 inches. Course G is the wearing portion of the upper surface course.

Because of the inclusion of the separation course E, a crack in any course below the separation course is prevented from proceeding upwardly to the F or G courses. Similarly, a crack in the upper wearing courses is prevented from proceeding downwardly to the lower support courses.

The prepared existing subgrade A may or may not have been properly prepared. Often it is not uniformly compacted, particularly in the cut and fill junctures. Often the cut areas are not scarified and recompacted for uniform density. The material is watered for compaction.

The subgrade will normally crack from loss of moisture (from optimum moisture) used in compaction and also from freeze-thaw cracking. Cracking can also be caused by moisture coming through the cracked or poorly compacted porous areas of course D. The subbase course B and the base course C exhibit the same cracking problems as the subgrade A.

The asphalt concrete surface course D will crack due to lack of correct amount of stress-relieving air voids if it is over-compacted. If it is under-compacted, it will be permeable, thereby allowing air and water to pass through it. Under-compaction (low density) also lowers stability and cohesion. Another problem with this course is low density joints. All of the foregoing, plus reflective cracking) lead to cracking of course D.

The separation course serves the function of allowing the lower layers A through D (support courses) to crack without putting a stress on the wearing course above it. Also, the layers above the separation course can expand and contract without any stress or influence from the layers below it.

The purpose of the asphalt protection course F is to protect the layer E from damage during construction. Layer F may be omitted if course G can be applied without disturbing or damaging the separation layer E.

The M-SAR resilient surface, the protection course, and the separation course may also be applied over a new asphalt concrete surface course, if desired.

Another variation of the system illustrated in FIG. 1 involves using a hot mix asphalt concrete surface course resurfacing overlay in place of the M-SAR resilient surface G. The thickness of the hot mix surface course may vary, as desired. This construction is useful for road and parking surfaces. Of course, the hot mix, protection course, and separation course may also be applied over new asphalt concrete surface course to prepare road or parking surfaces.

Figure 2:
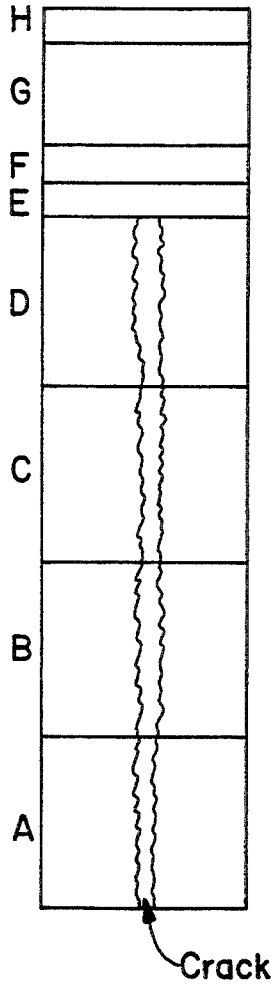

FIG. 2 is a schematic illustrating yet another variation where a top course H is applied over a hot mix asphalt concrete surface course G. The top course comprises up to about 0.5 inch of elastomeric athletic surfacing. The lower course are the types previously described herein.

Figure 3:
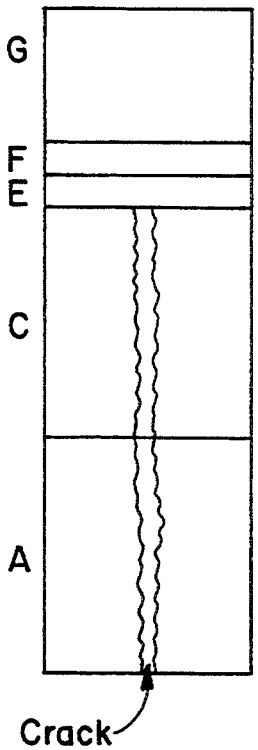

FIG. 3 is a schematic illustrating yet another variation where the M-SAR resilient surface is applied over the protection course F, separation course E, new base course C, and prepared subgrade A. This construction is especially useful as a sports surface.

Other variants are possible without departing from the scope of this invention.

What is claimed is:

1. A method for constructing a traffic-bearing pavement system over a substrate, the method comprising the steps of:

(a) providing a lower support course over said substrate;

(b) applying a separation course over said lower support course; wherein said separation course is water-impermeable; wherein said separation course comprises separate upper and lower water-impermeable plastic films which are not adhered to each other;

(c) applying a surface wearing course over said separation course;

wherein said surface wearing course is not adhered to said lower support course.

2. A method in accordance with claim 1, wherein said separation course serves as an impermeable barrier for preventing water from passing into said support course.

3. A method in accordance with claim 1, wherein said separation course is adapted to prevent cracking in said support course from proceeding into said surface wearing course.

4. A method in accordance with claim 1, wherein said separation course is adapted to prevent cracking in said surface wearing course from proceeding into said support course.

5. A method in accordance with claim 1, wherein said separation course comprises unbound granular material which is sandwiched between said upper and lower plastic films.

6. A method in accordance with claim 1, wherein said surface wearing course comprises asphalt concrete.

7. A method in accordance with claim 6, wherein said asphalt concrete comprises a modified sand-asphalt-rubber surface.

8. A method in accordance with claim 7, further comprising the step of reinforcing said asphalt concrete by including fibers therein.

9. A method in accordance with claim 1, wherein said separation course comprises lubricant which is sandwiched between said upper and lower plastic films.

* * * * *